US006309121B1

(12) United States Patent
Ohba

(10) Patent No.: US 6,309,121 B1
(45) Date of Patent: Oct. 30, 2001

(54) STICK-LIKE COSMETIC MATERIAL FEEDING OUT VESSEL

(75) Inventor: Atsushi Ohba, Tokyo (JP)

(73) Assignee: Suzuno Kasei Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/582,090

(22) PCT Filed: Nov. 2, 1999

(86) PCT No.: PCT/JP99/06106

§ 371 Date: Jun. 22, 2000

§ 102(e) Date: Jun. 22, 2000

(87) PCT Pub. No.: WO00/27241

PCT Pub. Date: May 18, 2000

(30) Foreign Application Priority Data

Nov. 5, 1998 (JP) ..... 10-328783

(51) Int. Cl.[7] ..... B43K 21/08

(52) U.S. Cl. ..... 401/78; 401/75; 401/88

(58) Field of Search ..... 401/78, 75, 77, 401/68, 55, 116, 88

(56) References Cited

U.S. PATENT DOCUMENTS 5,560,727 * 10/1996 Vaupel ..... 401/78
5,871,295 * 2/1999 Bouix ..... 401/78

FOREIGN PATENT DOCUMENTS

651582 * 4/1951 (GB) ..... 401/78
3-92413 9/1991 (JP) .
3-71121 11/1991 (JP) .

* cited by examiner

*Primary Examiner*—David J. Walczak
(74) *Attorney, Agent, or Firm*—Rabin & Berdo, P.C.

(57) ABSTRACT

A stick type cosmetic material feeding container for retaining a stick type cosmetic material using claws, which prevents deformation of the claws, retains the stick type cosmetic material stably and properly. By forming sliding projections 36 or sliding convex lines 39 on outer circumferential surfaces 38 of the claws 32 which constitute a cosmetic material retaining section 31, the sliding projections 36 or the sliding convex lines 39 are always in contact with sliding contact surfaces 14 of sliding grooves 13. Or, by forming sliding convex lines 51 on the sliding contact surfaces 14 covering at least stroke range of the claws 32, the sliding convex lines 51 and the outer circumferential surfaces 38 of the claws 32 are always in contact with each other.

11 Claims, 23 Drawing Sheets

(A)

(B)

STICK-LIKE COSMETIC MATERIAL FEEDING OUT VESSEL

TECHNICAL FIELD

The present invention relates to an improvement in a stick type cosmetic material feeding container for retaining a stick type cosmetic material of thin diameter (especially, eyeliner, eyebrow, lip liner, or the like) by a plurality of claws by enabling secure and appropriate retaining of the stick type cosmetic material having various physical properties according to the respective physical properties.

BACKGROUND ART

A stick type cosmetic material is made by mixing an oil with a pigment or a dye and hardening them and its characteristics, such as hardness, viscosity, or the like, vary depending on the type. Thus, various shapes of stick type cosmetic material feeding containers which can properly house a cosmetic material without damaging it by coping with such various characteristics have been proposed.

For example, in the case of a stick type cosmetic material having a large cross sectional area and strength, such as lipstick of large diameter, concealer, or the like, a lower end side of the stick type cosmetic material is retained in a cylindrical core chuck which is a cosmetic material retaining section. In this case, generally, the ratio of length of a part of the stick type cosmetic material which is retained at the core chuck to total length of the stick type cosmetic material is approximately 1 to 2 through 1 to 3.

On the other hand, in the case of a stick type cosmetic material of thin diameter, the ratio of length of a part of the stick type cosmetic material retained at the core chuck to total length of the stick type cosmetic material is, for example, approximately 1 to 5 through 1 to 6. However, such a stick type cosmetic material which is weak and has a thin diameter is easy to break, come off, or be damaged during the feeding operation.

In order to prevent such a stick type cosmetic material from breaking, coming off, or being damaged, for example, a stick type cosmetic material feeding container as shown in FIG. 20 has been proposed.

The stick type cosmetic material feeding container has a cylindrical core chuck 105. The stick type cosmetic material (not shown in the drawings) is inserted in the core chuck 105 and retained in a front cylinder 102 in such a manner that the cosmetic material can be fed. A step section 111 having a thickness equivalent to a thickness of the core chuck 105 is formed at an upper end of the front cylinder 102. Thus, an inside diameter of an upper end part (a part on the side of an opening hole 110) of the front cylinder 102 becomes small by a portion equivalent to a thickness of the core chuck 105, and the stick type cosmetic material is retained by the upper end part from right and left.

However, in the container shown in FIG. 20, there is a space equivalent to the thickness of the core chuck 105 between the stick type cosmetic material and an inner circumferential surface of the front cylinder 102 at a part of the front cylinder 102 which is under the step section 111. Therefore, especially in the case of a slender stick type cosmetic material, it is sometimes warped and broken due to a change of temperature or moisture, a shock, or the like.

In order to solve such problems, a stick type cosmetic material feeding container 201 as shown in FIGS. 21 through 23 is disclosed in Japanese Utility Model Laid-Open Publication No. Sho 60-33920 published by the Japanese Patent Office. Further, Japanese Patent Publication No. Hei 3-71121 discloses a stick type cosmetic material feeding container 301 as shown in FIG. 24.

In both of these stick type cosmetic material feeding containers 201 and 301, a plurality of claws 108 constitute a core chuck and a stick type cosmetic material A is retained by these claws 108. Further, a plurality of sliding grooves 106 is formed on an inner circumferential surface of the front cylinder 102 and the plurality of claws 108 are housed in these sliding grooves 106. Thus, the stick type cosmetic material A is supported from the side by parts other than the sliding grooves 106 provided on the inner circumferential surface of the front cylinder 102. Consequently, it is possible to prevent the stick type cosmetic material A from being bent.

However, the claws 108 which are adopted in such stick type cosmetic material feeding containers 201 and 301 are easy to be deformed and therefore when the stick type cosmetic material A is inserted, the claws 108 are occasionally spread outward as shown in FIGS. 23 and 24.

To be more precise, usually the claws 108 are rectangular pieces having elasticity and due to the elasticity, the stick type cosmetic material A is installed in such a manner that the cosmetic material is fastened. By making the claws 108 elastic as described above, the weak stick type cosmetic material A can be retained in such a manner that the cosmetic material is wrapped without being damaged. When the stick type cosmetic material A is supported by the claws 108, it will be ideal if the shape of the claws 108 is corresponding to the stick type cosmetic material A as shown in FIGS. 21 and 22.

However, actually the claws 108 are spread outward as shown in FIGS. 23 and 24 due to pressure applied at the time of inserting the stick type cosmetic material A. Therefore, it is possible for the stick type cosmetic material A to separate from the core chuck 105 merely by a slight shock which may be applied resulting from a fall, a consecutive oscillation, or the like.

For this problem, if strength of the claws 108 is enhanced by taking countermeasures such that the thickness of the claws is increased and the cross section is enlarged, the claws will become hard to be deformed. However, the thickness of the claws 108 is increased and flexibility of the front cylinder in design is spoiled.

The present invention is made in consideration of such problems. An object of the present invention is to provide a stick type cosmetic material feeding container which stably and properly retains a stick type cosmetic material using claws according to physical properties of the stick type cosmetic material.

DISCLOSURE OF THE INVENTION

In the present invention, a stick type cosmetic material feeding container comprising: a front cylinder which houses a stick type cosmetic material in such a manner that the stick type cosmetic material can advance and retreat; a container body which is rotatably connected with the front cylinder; a cosmetic material retaining section composed of a plurality of claws which retain the stick type cosmetic material in such a manner that the stick type cosmetic material is sandwiched; and a plurality of sliding grooves which are formed on an inner circumferential surface of the front cylinder and in which the claws are housed, wherein the stick type cosmetic material is fed up or fed down by advancement or retreat of the cosmetic material retaining section resulting from rotations of the front cylinder and the container body; characterized in that a sliding contact section is provided on at least either an outer circumferential surface of the respective claws or a sliding contact surface of the respective sliding grooves; and each of the claws is always in contact with the sliding contact surface via the sliding contact section when the stick type cosmetic material is supported between the claws.

Thus, each of the claws is supported by the sliding contact surface via the sliding contact section, and therefore when the stick type cosmetic material is installed between the claws, the claws are not spread outward (toward the sliding contact surface side) more than planned by design. Since a deformation of the claws is effectively prevented as described above, the stick type cosmetic material is stably retained and can stably be fed up or fed down.

Further, in the present invention, the sliding contact section is a projection which is formed on an outer circumferential surface of each of the claws. Thus, a contact area of the projection and the sliding contact surface which covers only a tip of the projection can be a required minimum, whereby large frictional resistance does not arise. Therefore, a stroke of the stick type cosmetic material can be performed smoothly.

Further, in the present invention, the sliding contact section is a convex line which is formed covering approximately total length of the outer circumferential surface of the respective claws. Thus, the claws are stably supported by the sliding contact surfaces. Further, since the elasticity of the claws can be decreased, the present invention is suitable for a kind of stick type cosmetic material which requires support by the claws which are not easy to be deformed.

Further, in the present invention, the convex line has an approximately triangular cross section and also it comes into contact with the sliding contact surface at an apex of the triangle. Thus, a contact area of the convex line and the sliding contact surface can be a required minimum, whereby large frictional resistance will not arise. Therefore, the stroke of the stick type cosmetic material can be carried out smoothly.

Further, in the present invention, the sliding contact section is a convex line which is formed on the sliding contact surface covering at least a stroke range of the respective claws. Thus, the claws are supported by the sliding contact surfaces very stably.

Further, in the present invention, the convex line has an approximately triangular cross section and also it comes into contact with an outer circumferential surface of the respective claws at the apex of the triangle. Thus, a contact area of the convex line and the outer circumferential surface of the respective claws can be a required minimum, whereby large frictional resistance will not arise. Therefore, the stroke of the stick type cosmetic material can be carried out smoothly.

Further, in the present invention, a flat part is formed on an inner circumferential surface of the respective claws. Thus, the stick type cosmetic material is easily deformed when installed between the claws. Therefore, the stick type cosmetic material can be supported easily and stably. Further, since a contact area of the stick type cosmetic material and the inner circumferential surface of the respective claws can be reduced, a possibility of damaging the stick type cosmetic material can be decreased.

Further, in the present invention, by providing a difference in level on the inner circumferential surface of the respective claws, a cross sectional area surrounded by the inner circumferential surface of the respective claws is narrower at a section under the difference in level than at a section above the difference in level and the stick type cosmetic material is installed from a side above the difference in level. Thus, the stick type cosmetic material can easily be installed from the upper side and can securely be retained on the lower side.

Further, in the present invention, by engaging the claws with the sliding grooves, it is prevented the claws from escaping in a direction of an inside diameter of the front cylinder. Thus, the claws are engaged with the sliding grooves and it is prevented the claws from escaping from the sliding grooves, whereby the claws do not fall in a direction of the inside diameter of the front cylinder and do not bend.

Further, in the present invention the sliding contact section is an outer circumferential surface of the respective claws which is formed by a columnar member. Therefore, a contact area of the sliding contact surface and the outer circumferential surface which is formed by the columnar member is small, whereby large frictional resistance does not arise and the stroke of the stick type cosmetic material is not obstructed. Further, since a contact area of the columnar member and the stick type cosmetic material is small, a possibility of damaging the stick type cosmetic material is decreased.

Further, in the present invention, an unevenness is formed in a region between the sliding grooves formed on the inner circumferential surface of the front cylinder. Thus, in the region between the sliding grooves formed on the inner circumferential surface of the front cylinder, a place to which the stick type cosmetic material may be stuck can be diminished in size. Therefore, even though the stick type cosmetic material has large viscosity, the stick type cosmetic material can be supported from the side with the distance between the inner circumferential surface of the front cylinder and the stick type cosmetic material being narrowed.

DESCRIPTION OF THE DRAWINGS

FIG. 2(A) shows a case that an inner circumferential surface of a claw is flat.

FIG. 2(B) shows a case that the inner circumferential surface of the claw is circular arc.

FIG. 9(A) shows a case that a stick type cosmetic material has not been inserted.

FIG. 9(B) shows a case that a stick type cosmetic material is inserted.

FIG. 10(B) is a sectional view taken along line D—D of FIG. 9.

BEST MODE FOR CARRYING OUT THE INVENTION

Figure 1:
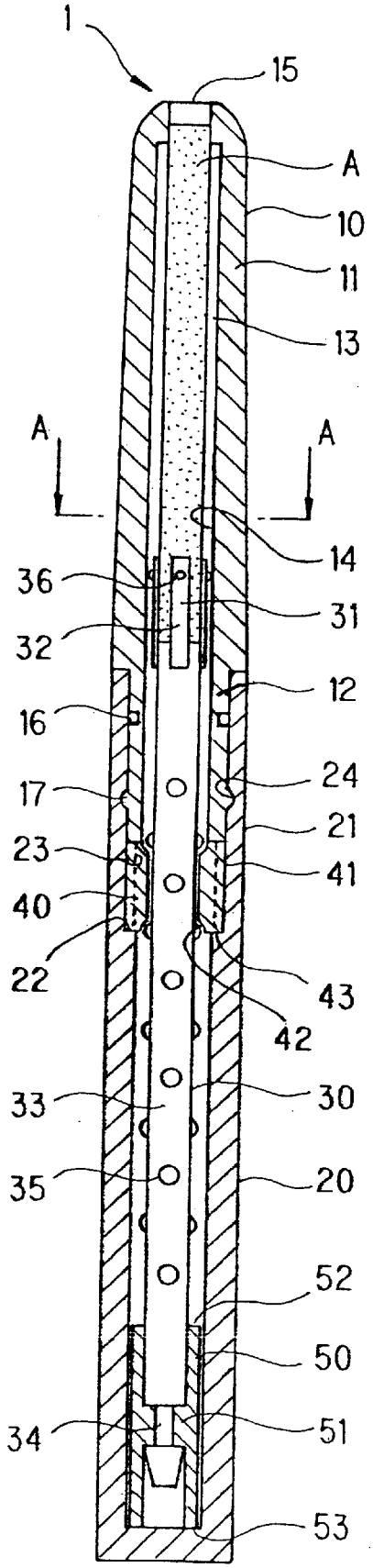
FIG. 1 is a longitudinal sectional view showing a stick type cosmetic material feeding container according to a first embodiment of the present invention.
Figure 2:
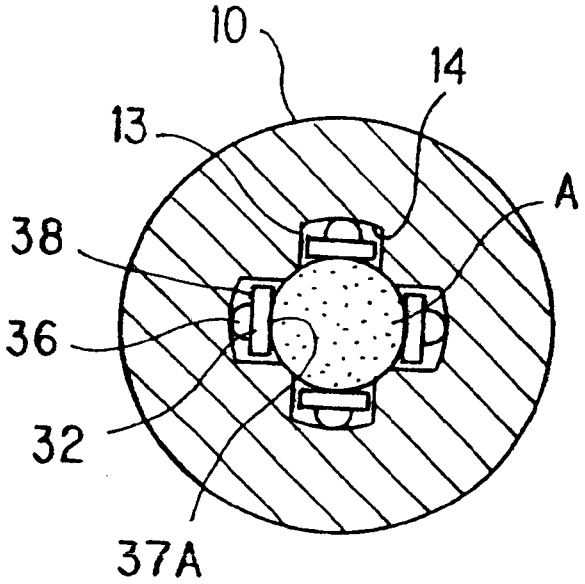
FIG. 2 is a sectional view taken along line A—A of FIG. 1.
Figure 2:
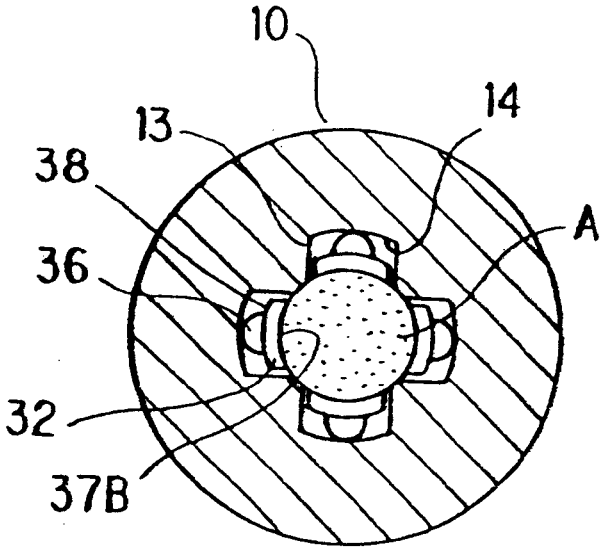

More detailed description of the present invention will be given with reference to the accompanying drawings.

FIGS. 1 through 5 show a stick type cosmetic material feeding container 1 according to a first embodiment of the present invention, respectively.

As shown in the drawings, the stick type cosmetic material feeding container 1 is composed of a front cylinder 10, a container body 20, a push rod 30, a spiral body 40, and a stopper member 50.

The front cylinder 10 is composed of an exposed section 11 provided at the upper part and a rotation section 12 provided at the lower part. The rotation section 12 is rotatably fitted in a rotary section 21 of the container body 20. Further, at an upper end of the exposed section 11, an opening hole 15 through which a stick type cosmetic material A can advance and retreat is formed. Incidentally, a shape of the cross section of the stick type cosmetic material A is a circular cross section having almost the same diameter as that of the opening hole 15 so that the stick type cosmetic material A can be inserted in the opening hole 15.

Further, on an inner circumferential surface of the front cylinder 10, four sliding grooves 13 are formed extending in an axial direction. Claws 32 formed at an upper part of the push rod 30 are arranged in these sliding grooves 13.

The container body 20 is a cylindrical body having a bottom. An upper end opening side of the container body 20 is the rotary section 21. An annular concavity section 24 is formed at an inner circumference of the rotary section 21. An annular convex section 17 of the front cylinder 10 is fitted in the annular concavity section 24 in such a manner that the annular convex section 17 cannot come off.

Incidentally, an O-ring 16 is provided between the front cylinder 10 and the container body 20. The O-ring 16 applies appropriate frictional resistance to rotations of the front cylinder 10 and the container body 20.

Further, a step section 22 on which the spiral body 40 is to be placed is provided in a sublevel of the container body 20. Longitudinal ribs 23 are provided at the step section 22. The longitudinal ribs 23 are synchronously engaged with engagement line sections 41 formed on an outer circumferential surface of the spiral body 40. Thus, the container body 20 and the spiral body 40 synchronously rotate.

The spiral body 40 is a cylindrical member and a spiral groove 42 is formed on an inner circumferential surface of the spiral body 40. The spiral groove 42 is spirally engaged with a plurality of engagement projections 35 arranged on the push rod 30.

The push rod 30 is composed of a cosmetic material retaining section 31 comprising four claws 32 and a beam 33 which extends downward from the cosmetic material retaining section 31.

For example, the claws 32 are almost rectangular pieces with a thickness of approximately 0.5 mm, respectively, and they are arranged at the upper end of the push rod 30 at an interval of approximately 90 degrees. These claws retain the stick type cosmetic material A from four sides by their inner circumferential surfaces 37. Incidentally, usually a stick type cosmetic material A having a circular or elliptical cross section is adopted.

Further, an inner circumferential surface 37A which is flat as shown in FIG. 2(A), an inner circumferential surface 37B which is a circular arc almost the same as the stick type cosmetic material A as shown in FIG. 2(B), or the like can selectively be adopted as the inner circumferential surface 37 of the respective claws 32.

As shown in FIG. 2(A), if the inner circumferential surface 37A of the respective claws 32 is a flat surface, a space between the claws 32 which face each other will be slightly narrower than an outside diameter of the stick type cosmetic material A and the stick type cosmetic material A will be pushed between the claws 32. Thus, a part of the outside diameter of the stick type cosmetic material A which is in contact with the flat inner circumferential surface 37A of the respective claws 32 will be deformed into a flat plate. (It is similar to the case that a part of tire which is in contact with road surface is deformed into a flat plate, whereby the contact area is increased and frictional resistance is increased.)

In this case, the inner circumferential surface 37A are flat, and therefore as compared with the case of the circular arc inner circumferential surfaces 37B shown in FIG. 2(B), even though the stick type cosmetic material A is deformed into a shape corresponding to the shape of the respective flat inner circumferential surfaces 37A, there is a space of relief equivalent to the deformed portion of the stick type cosmetic material A, whereby the stick type cosmetic material A can easily be deformed. Therefore, the stick type cosmetic material A is securely retained by the claws 32.

Further, by making the inner circumferential surfaces 37A flat, a contact area of the stick type cosmetic material A and the respective inner circumferential surfaces 37A becomes smaller than the case of the circular arc inner circumferential surfaces 37B shown in FIG. 2(B).

Incidentally, since sliding projections 36 formed on outer circumferential surfaces 38 of the claws 32 are in contact with sliding contact surfaces 14 as will be described hereinafter, even though the stick type cosmetic material A is pushed between the claws 32, a space between the claws 32 is not widened more than planned.

On the other hand, if the inner circumferential surface of the respective claws 32 is a circular arc surface as shown in FIG. 2(B), the stick type cosmetic material A can be retained without being deformed so much.

As described above, a shape of the inner circumferential surface 37 of the respective claws 32 can be selected according to characteristics (hardness, viscosity, or the like) of the stick type cosmetic material A. For example, for the stick type cosmetic material A which is relatively soft and viscous, the flat inner circumferential surfaces 37A are adopted. In this case, according to characteristics of the stick type cosmetic material A, the length of the respective flat inner circumferential surfaces 37A is adjusted. On the other hand, in the case of the stick type cosmetic material A which is relatively hard and weak, the circular arc inner circumferential surfaces 37B are adopted and deformation of the stick type cosmetic material A is minimized. Further, the flat inner circumferential surfaces 37A and the circular arc inner circumferential surfaces 37B can be used jointly (for example, two of the total of four claws 32 have the flat inner circumferential surfaces 37A and the other two have the circular arc inner circumferential surfaces 37B or the constitution according to a third embodiment which will be described hereinafter is adopted) (refer to FIGS. 9 and 10).

Each one of the sliding projections 36 is formed at the outer circumferential surface 38 of the respective claws 32. These sliding projections 36 are sliding contact sections, and at least when the stick type cosmetic material A is inserted between the claws 32, the sliding projections 36 are always in contact with the sliding contact surfaces 14 of the sliding grooves 13. Incidentally, in this embodiment, the sliding projections 36 are almost semi-spherical.

The plurality of engagement projections 35 are arranged on an outer circumferential surface of a beam 33 at equal intervals. As described above, these plurality of engagement projections 35 arc engaged with the spiral groove 42 which is arranged in the spiral body 40. Thus, the engagement projections 35 operate as male screws.

These engagement projections 35 and claws 32 are arranged on an identical straight line in an axial direction of the push rod 30. More specifically, the engagement projections 35 are arranged in four rows at the respective lower parts of the four claws 32. When fed toward the upper part of the spiral body 40, the plurality of engagement projections 35 are synchronously engaged with the sliding grooves 13 of the front cylinder 10. Thus, the front cylinder 10 and the push rod 30 synchronously rotate.

Further, a width of the respective engagement projections 35 in a circumferential direction is equal to or wider than that of the respective claws 32. Thus, the engagement projections 35 bear a load from right and left (from a side surface of the respective sliding grooves 13) during the stroke of the push rod 30, whereby no load is applied to the claws 32 from right and left.

An annular concavity 34 is formed at a lower end of the beam 33. The annular concavity 34 is engaged with an annular convex 51 formed inside the stopper member 50. Due to the engagement, the stopper member 50 is fitted to the push rod 30. Based on an upper end surface 52 and a rear end surface 53 of the stopper member, an upper stroke limit and a lower stroke limit of the push rod 30 are defined. Thus, since the stopper member 50 bears a vertical load at the upper stroke limit and the lower stroke limit of the push rod 30, no vertical load is applied to the claws 32.

Operation will subsequently be described.

When the front cylinder 10 is rotated with the container body 20 fixed, the spiral body 40 synchronously engaged with the container body 20 and the push rod 30 synchronously engaged with the front cylinder 10 rotate relatively to each other. Thus, due to operation of a feeding mechanism caused by spiral engagement of the spiral groove 42 of the spiral body 40 with the engagement projections 35 provided at the outer circumference of the push rod 30, the push rod 30 advances upward. In this case, the engagement projections 35 which moved upward and passed through the spiral body 40 arc engaged with the sliding grooves 13 formed in the front cylinder 10 and serve as a rotation stop of the push rod 30 and the front cylinder 10. With the advance of the push rod 30, the stick type cosmetic material A retained by the stick type cosmetic material retaining section 31 is fed through the opening hole 15 provided at an upper end of the front cylinder 10.

Figure 3:
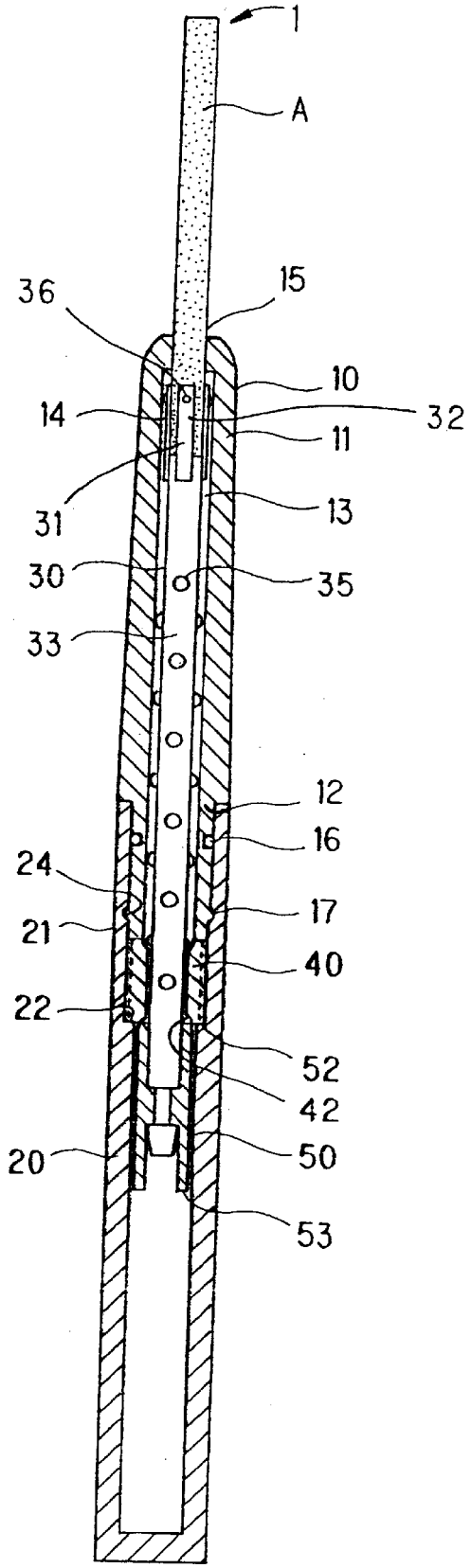
FIG. 3 is a longitudinal sectional view showing the stick type cosmetic material feeding container at a feeding upper limit.
Figure 4:
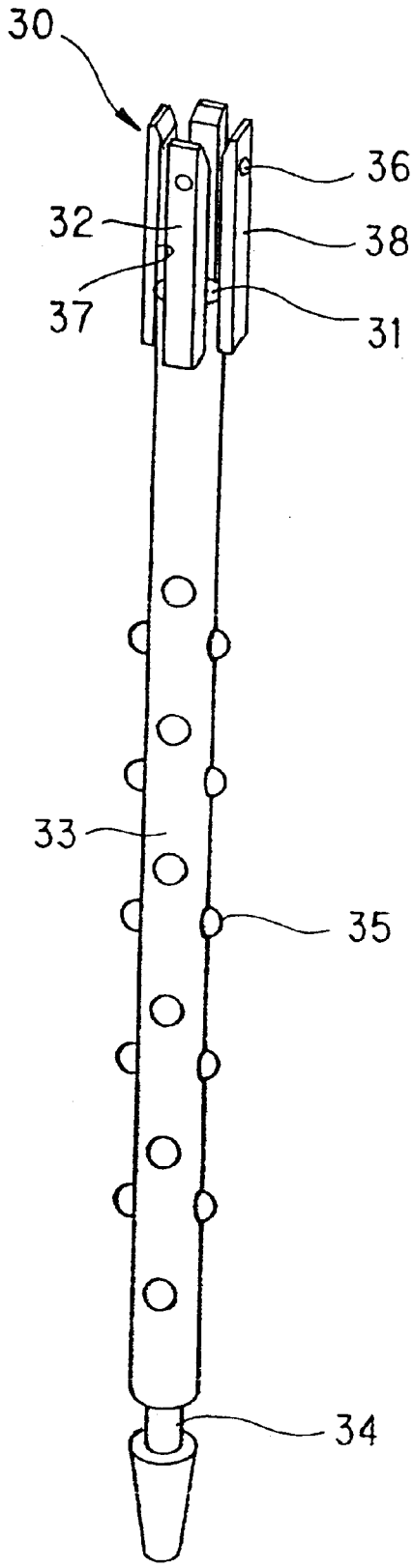
FIG. 4 is a perspective view showing a push rod according to the first embodiment of the present invention.
Figure 5:
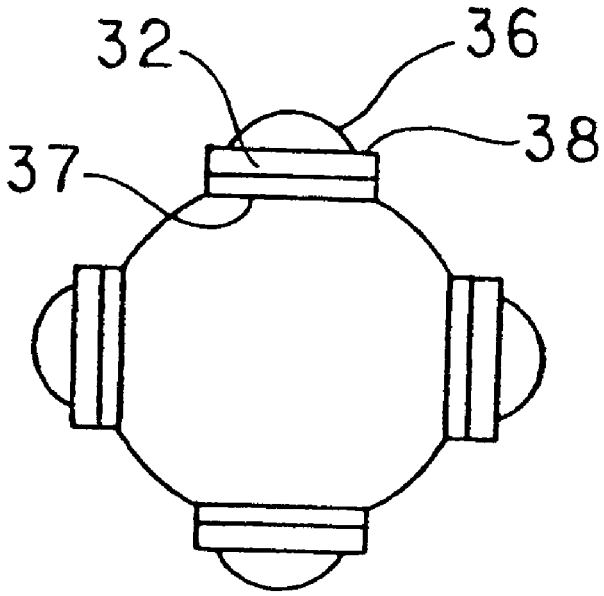
FIG. 5 is a plan view showing the push rod.

If such rotations of the container body 20 and the front cylinder 10 are continued, the upper end surface 52 of the stopper member 50 fitted in the annular concavity 34 provided at the rear end of the push rod 30 will come into contact with a lower end surface 43 of the spiral body 40 in due time. Thus, the stroke of the push rod 30 will be at the upper limit as shown in FIG. 3.

Further, when the front cylinder 10 and the container body 20 are rotated in a reverse direction, the push rod 30 retreats downward. And when the rear end surface 53 of the stopper member 50 and a bottom surface of the container body 20 come into contact with each other, the stroke of the push rod reaches the retreat limit.

During such feeding up stroke and feeding down stroke of the push rod 30, the sliding projections 36 formed on the outer circumferential surfaces 38 of the claws 32 are always in contact with the sliding contact surfaces 14. Thus, even though the claws 32 have elasticity, they will not spread outward, whereby the claws 32 can securely retain the stick type cosmetic material A by their inner circumferential surfaces 37. Therefore, the stick type cosmetic material A will not come off, and feeding up and feeding down operation can securely be performed.

Further, in this case, a contact area of the respective sliding projections 36 and the respective sliding contact surfaces 14 covering only the front end section of the respective projections is a required minimum, thereby minimizing a possibility of occurrence of the frictional resistance which may impede the stroke of the push rod 30. Thus, the feeding up and feeding down operation of the push rod 30 can smoothly be carried out. Incidentally, it is possible to make the sliding projections 36 square or the like as occasion demands.

An assembling method of the stick type cosmetic material feeding container 1 according to this embodiment will subsequently be described.

In assembling, first the push rod 30 is inserted in the spiral body 40 from the lower end side (from the side of the annular concavity 34 of the beam 33). Attended with the insertion, the plurality of engagement projections 35 at the outer circumference of the push rod 30 are spirally engaged with the spiral groove 42 of the spiral body 40. Next, by fitting the annular convex section 51 of the stopper member 50 in an annular concave section 34 of the beam 33, the stopper member 50 is fitted to the lower part of the push rod 30. Thus, a unit composed of the push rod 30, the spiral body 40, and the stopper member 50 is constituted.

Subsequently, a lower part side of the push rod 30 of the unit is placed in the container body 20. In this case, the engagement line sections 41 provided on an outer circumferential surface of the spiral body 40 are synchronously engaged with the longitudinal ribs 23 formed in the container body described above.

After the unit composed of the push rod 30 or the like is placed in the container body 20 in the manner described above, the front cylinder 10 is fitted to the unit. In this case, the front cylinder 10 is assembled in such a manner that the claws 32 at the upper end of the push rod 30 are engaged with the sliding grooves 13 formed on the inner circumferential surface of the front cylinder 10. Assembly is completed when the annular convex 17 of the rotation section 12 of the front cylinder 10 is fitted in the annular concavity 24 installed at the rotary section 21 of the container body 20.

Figure 6:
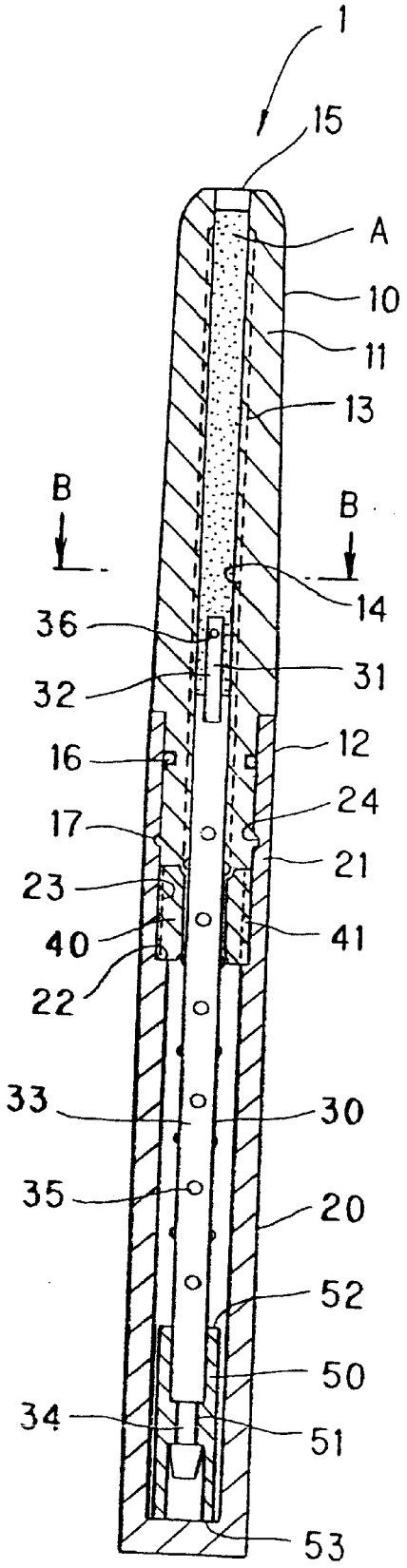
FIG. 6 is a longitudinal sectional view showing a stick type cosmetic material feeding container according to a second embodiment of the present invention.
Figure 7:
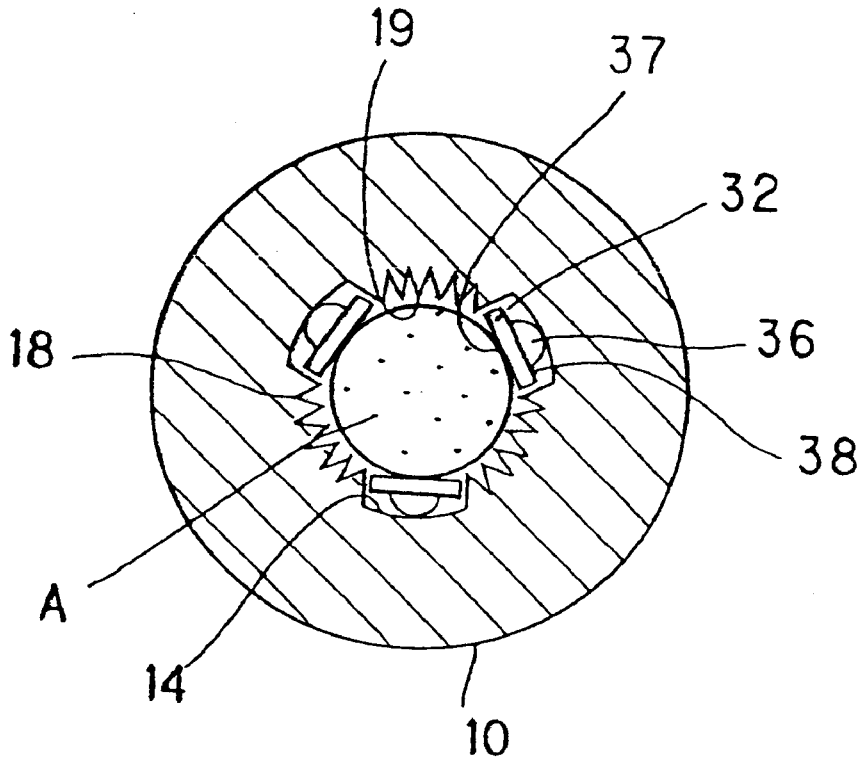
FIG. 7 is a sectional view taken along line B—B of FIG. 6.
Figure 8:
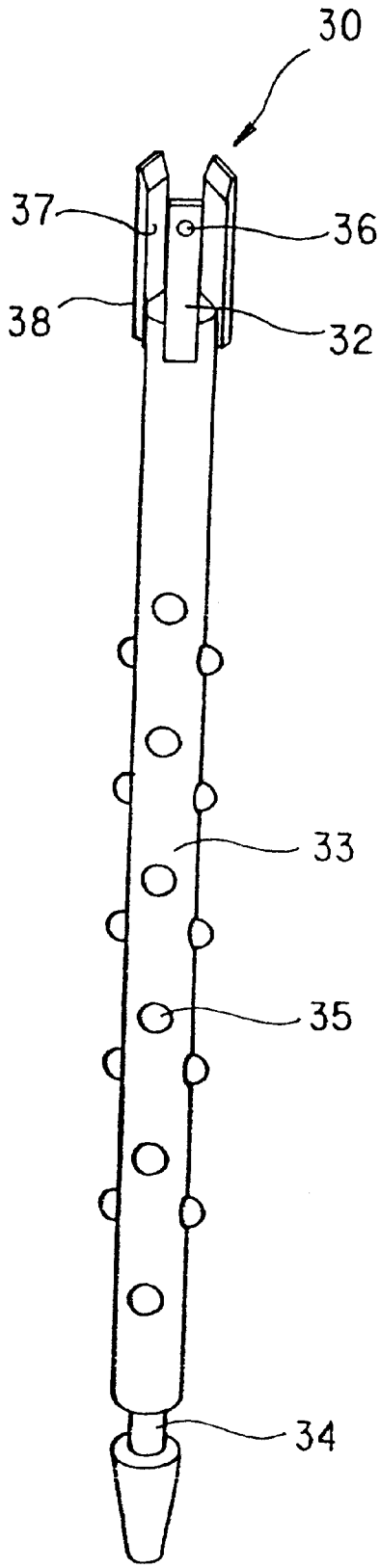
FIG. 8 is a perspective view showing a push rod according to the second embodiment of the present invention.

In FIGS. 6 through 8, a second embodiment according to the present invention will be shown.

As shown in the drawings, in this embodiment, three pieces of claws 32 constitute a section of retaining the stick type cosmetic material A. These claws 32 are arranged with the central angle being an isometric angle of approximately 120 degrees. Thus, the number of the claws 32 can be changed according to hardness, thickness, or the like of the stick type cosmetic material A.

Further, an unevenness 19 composed of many longitudinal grooves is formed in a region between the sliding grooves 13 provided on an inner circumferential surface 18 of the front cylinder 10. Due to the unevenness 19, it is possible for the stick type cosmetic material A to be in contact with the inner circumferential surface 18 of the front cylinder 10 with its contact area being small. Thus, even though the soft (viscous) stick type cosmetic material A comes into contact with the inner circumferential surface 18 of the front cylinder 10, the stick type cosmetic material A and the inner circumferential surface 18 of the front cylinder 10 do not stick to each other. Thus, even the stick type cosmetic material A having high viscosity can be securely supported with the stick type cosmetic material A being in contact with the inner circumferential surface 18 of the front cylinder 10.

Incidentally, it is all right to manufacture the unevenness 19 simultaneously with the sliding grooves 13 (by integral molding). Further, the unevenness 19 is composed of longitudinal grooves which are arranged at regular intervals in this embodiment, but the present invention is not restricted to such an embodiment. It is also preferable to install the unevenness 19 having an irregular shape at an appropriate part of the inner circumferential surface 18 of the front cylinder 10.

Figure 9:
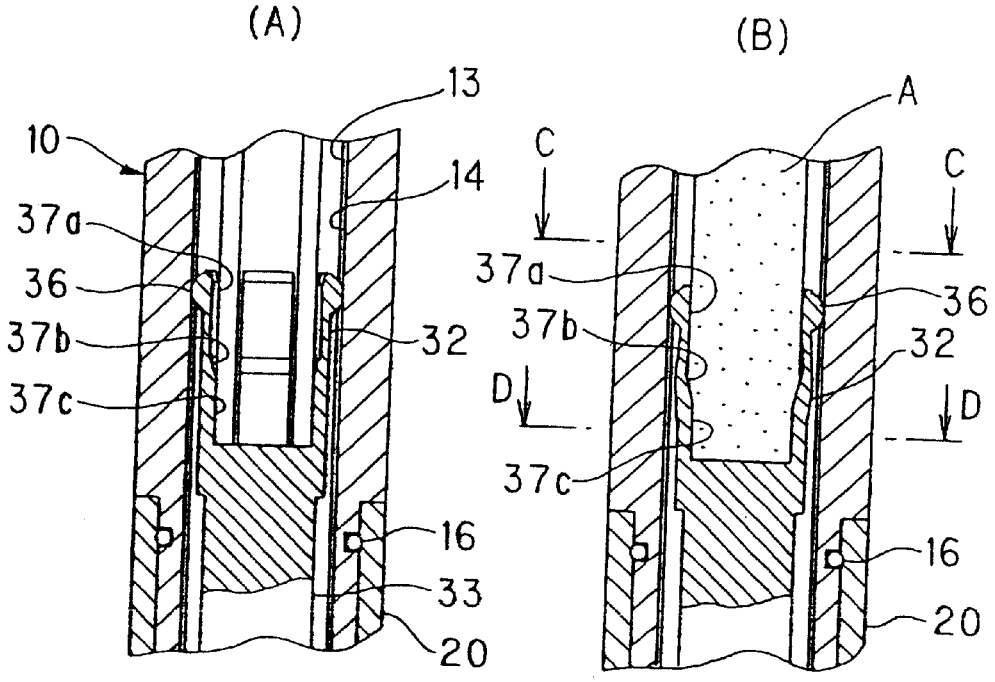
FIG. 9 is a partially sectional view showing a stick type cosmetic material feeding container according to a third embodiment of the present invention.
Figure 10:
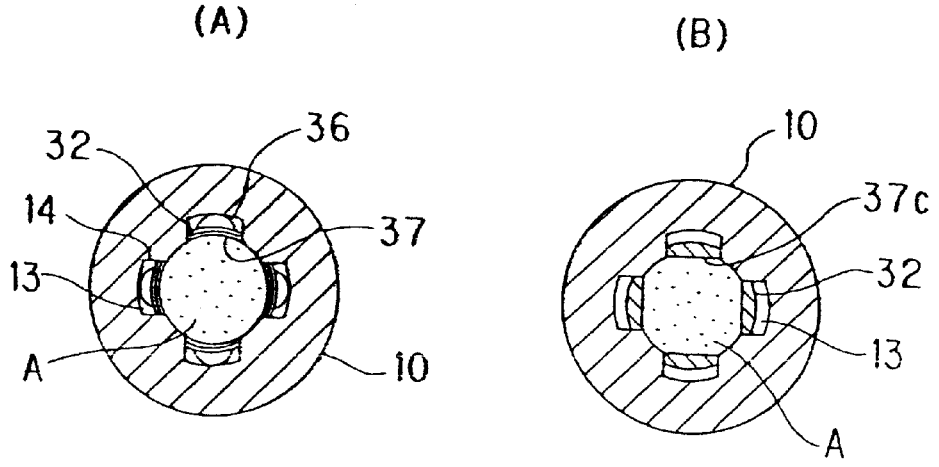
FIG. 10 (A) is a sectional view taken along line C—C of FIG. 9.

In FIGS. 9 and 10, a third embodiment according to the present invention will be shown.

This embodiment differs from the first and second embodiments described above in a form of the claws 32.

To be precise, in this embodiment, the inner circumferential surface of the respective claws 32 is divided into an upper part 37*a* and a lower part 37*c* and a difference in level 37*b* is installed between the upper part 37*a* and the lower part 37*c* as shown in FIG. 9(A). The difference in level 37*b* is inclined from the upper part 37*a* to the lower part 37*c*. An inside diameter of the lower part 37*c* is smaller than an inside diameter of the upper part 37*a* by a portion equivalent to the difference in level 37*b*.

The stick type cosmetic material A having an outside diameter which is slightly larger than the inside diameter of the lower part 37*c* is inserted between the claws 32 shown in FIG. 9(A) and it is pushed to the side of the lower part 37*c* of the respective claws 32. Thus, the state shown in FIG. 9(B) is brought about.

At this time, the lower part 37*c* of the respective claws 32 having elasticity is spread due to pressure applied by the stick type cosmetic material A. However, since the sliding projections 36 provided at the outer circumferential surfaces of the claws 32 are in contact with the sliding contact surfaces 14 of the front cylinder 10, the claws 32 are not spread more than planned. Therefore, the claws 32 can retain the stick type cosmetic material A mainly at their lower parts 37*c* with proper pressure.

Further, in installation of the stick type cosmetic material A, the stick type cosmetic material A is inserted in the upper part 37*a* having a large diameter and then pushed to the lower part 37*c* via the step section 37*b*.Therefore, the stick type cosmetic material A can smoothly be pushed to the lower part 37*c*.

Further, it is preferable that the diameter of the stick type cosmetic material A is smaller than the inside diameter of the upper part 37*a* and larger than the inside diameter of the lower part 37*c* in anticipation of a design tolerance for the size. Thus, the claws 32 can retain with proper pressure the stick type cosmetic material A having a design tolerance for the size.

As shown in FIG. 10(B) {a sectional view taken along line D—D of FIG. 9(B)}, the lower part 37*c* of the respective claws 32 is a flat surface. Thus, the stick type cosmetic material A pushed to the lower part 37*c* is easily deformed into a flat plate and securely retained.

Further, as shown in FIG. 10(A) {a sectional view taken along line C—C of FIG. 9(B)}, the upper part 37*a* of the respective claws 32 has a cross section in the shape of a circular arc almost the same as the outer circumferential surface of the stick type cosmetic material A. Incidentally, it is all right for the upper part 37*a* to be a flat surface similarly to the inner circumferential surface of the lower part 37*c*.

Further, it is possible to change the location of the step section 37*b* of the respective claws 32 according to the characteristics of the stick type cosmetic material A, such as hardness or the like. In other words, by making the upper part 37*a* of the inner circumferential surface longer or shorter, it is possible to subtly change the pressure used for retaining the stick type cosmetic material A.

Figure 11:
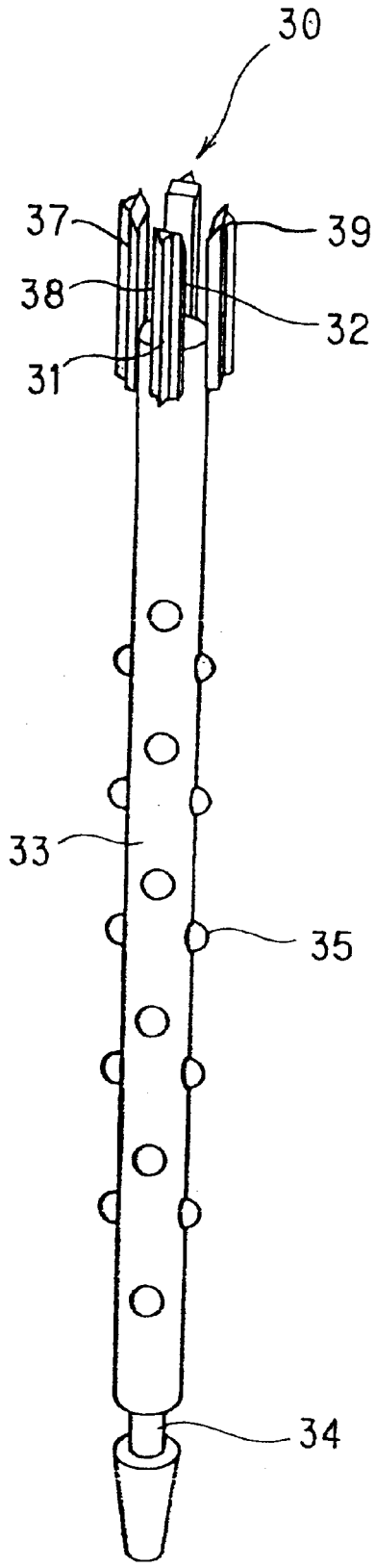
FIG. 11 is a perspective view showing a push rod according to a fourth embodiment of the present invention.
Figure 12:
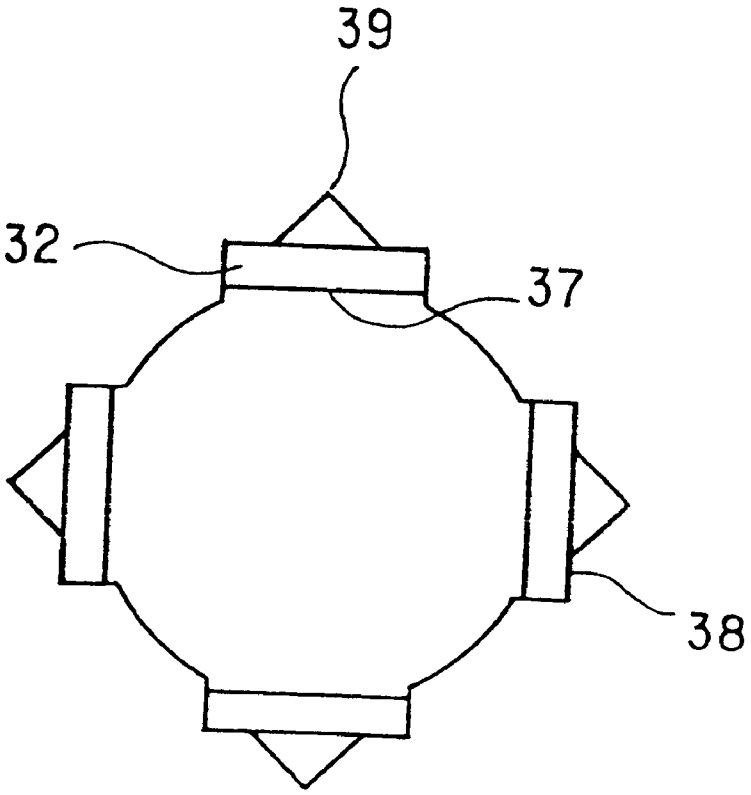
FIG. 12 is a plan view showing the push rod.

In FIGS. 11 and 12, a fourth embodiment according to the present invention will be shown.

In this embodiment, at the outer circumferential surface of the respective claws 32, sliding convex lines (ribs) 39 are formed as sliding contact sections instead of the sliding projections 36 according to the first through third embodiments.

The sliding convex lines 39 are formed in an axial direction covering the total length of the outer circumferential surface 38 of the respective claws. Therefore, each of the claws 32 is securely supported by the sliding contact surface 14 via the sliding convex line 39.

Further, each of the sliding convex lines 39 has a cross section in the shape of a triangle and comes into contact with the sliding contact surface 14 at the apex of the triangle. Therefore, a contact area of the respective sliding convex lines 39 and the respective sliding contact surfaces 14 is a required minimum, and therefore it is possible to minimize a possibility of occurrence of frictional resistance, which may impede the stroke of the push rod 30, between the sliding convex lines 39 and the sliding contact surfaces 14. In other words, by specially making the cross section of the respective sliding convex lines 39 triangular, it is possible to have a shape which can minimize frictional resistance between the sliding convex lines 39 and the sliding contact surfaces 14.

Further, due to the presence of the sliding convex lines 39, elasticity of the respective claws 32 is small extending the overall length. Thus, this embodiment is suitable for the case that the claws 32 should be inelastic according to the characteristics of the stick type cosmetic material A. (Incidentally, the first through third embodiments described above differ from this embodiment in that the claws 32 which are not thick, but have large elasticity are used.)

Figure 13:
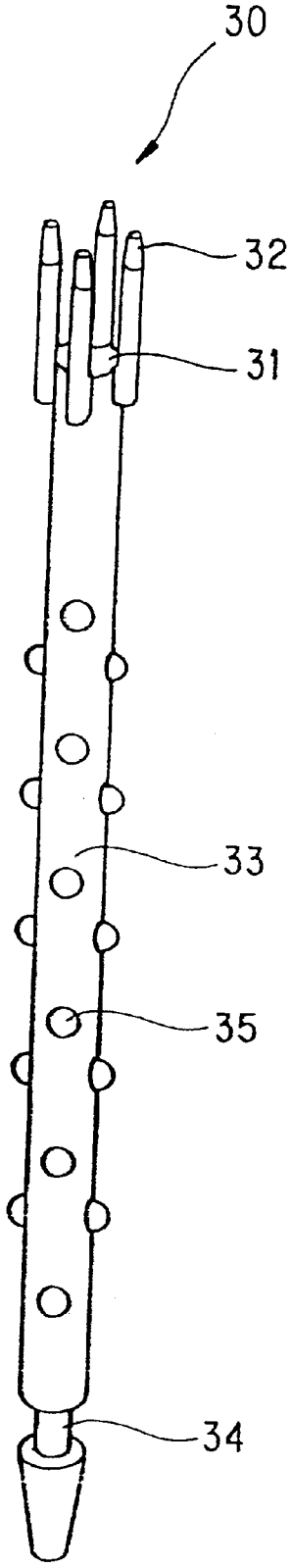
FIG. 13 is a perspective view showing a push rod according to a fifth embodiment of the present invention.
Figure 14:
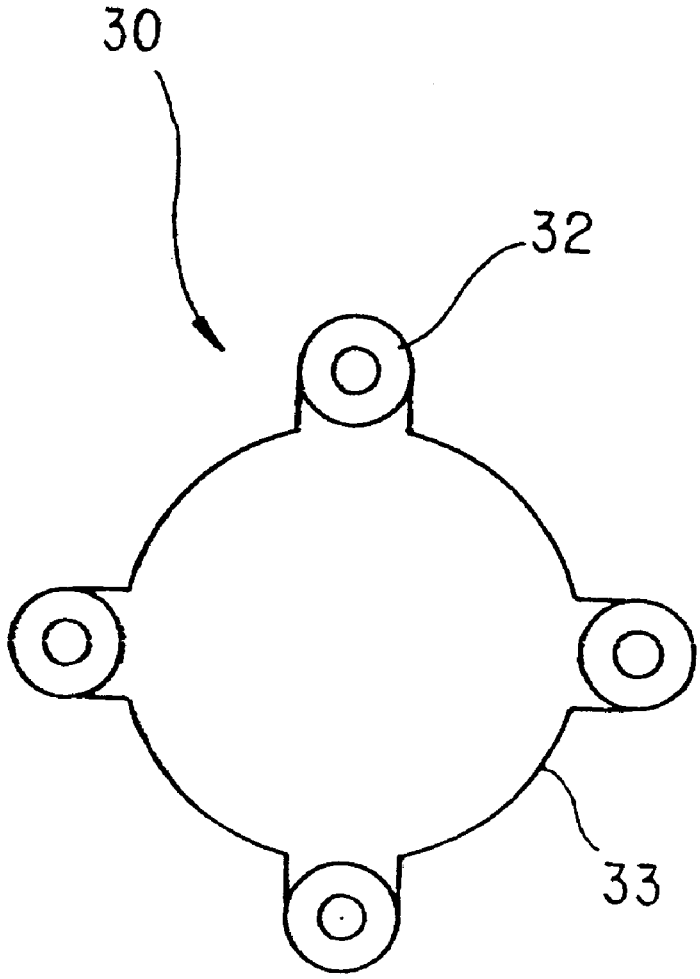
FIG. 14 is a plan view showing the push rod.

In FIGS. 13 and 14, a fifth embodiment according to the present invention will be shown.

In this embodiment, the claws are cylindrical. These claws 32 are arranged at an isometric angle (at regular intervals) of approximately 90 degrees and retain the stick type cosmetic material A. Thus, four cylinders which require a small area retain the stick type cosmetic material A, and therefore this embodiment is suitable for retaining the stick type cosmetic material A which has high viscosity and the stick type cosmetic material A can securely be retained.

Further, in this embodiment, as a sliding contact section, an outer circumferential surface of each of the claws 32 which is on the opposite side of the stick type cosmetic material A comes into contact with the respective sliding contact surfaces 14 of the front cylinder 10. Therefore, the claws 32 are not deformed, whereby the claws 32 can retain the stick type cosmetic material A in an inelastic condition. Further, for the contact of the respective cylindrical claws 32 with the respective sliding contact surfaces 14, it only requires a small area, and therefore a possibility of occurrence of frictional resistance can be minimized and the stroke of the push rod 30 will not be impeded.

Figure 15:
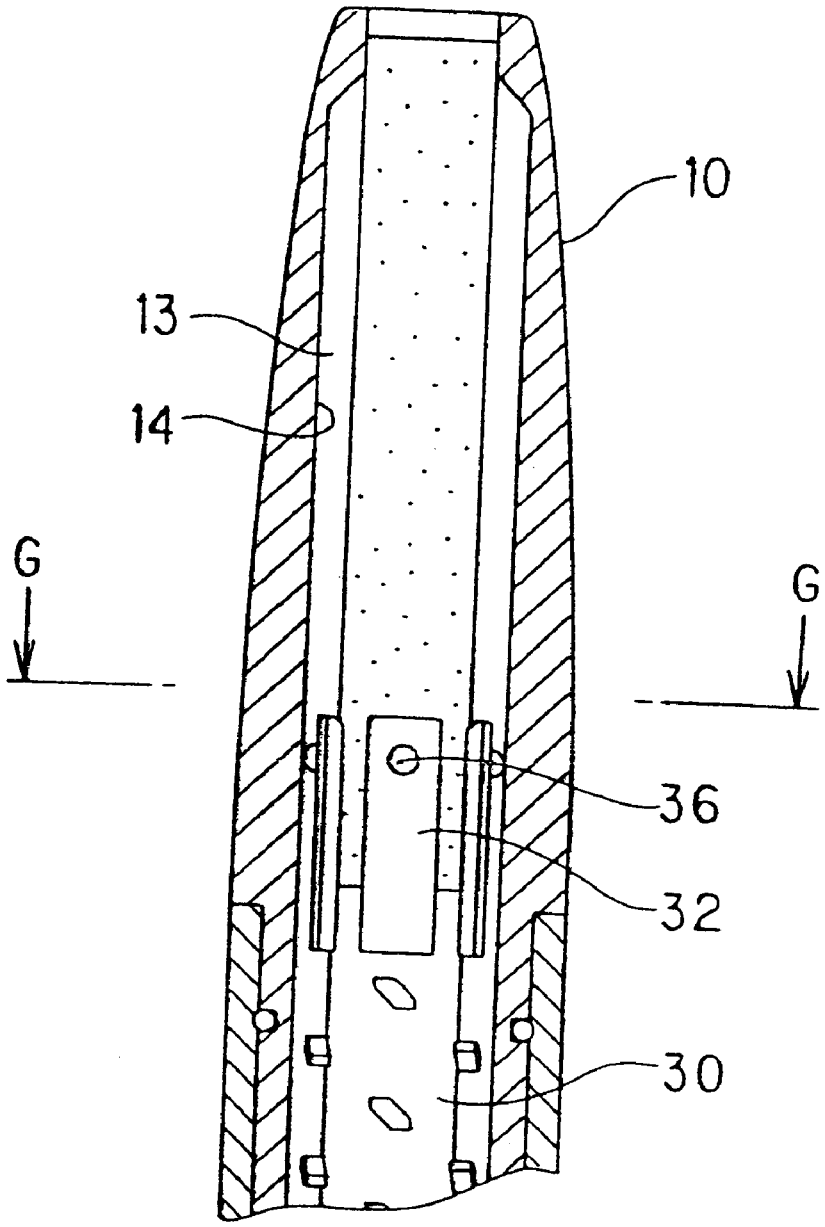
FIG. 15 is a partially sectional view showing a stick type cosmetic material feeding container according to a sixth embodiment of the present invention.
Figure 16:
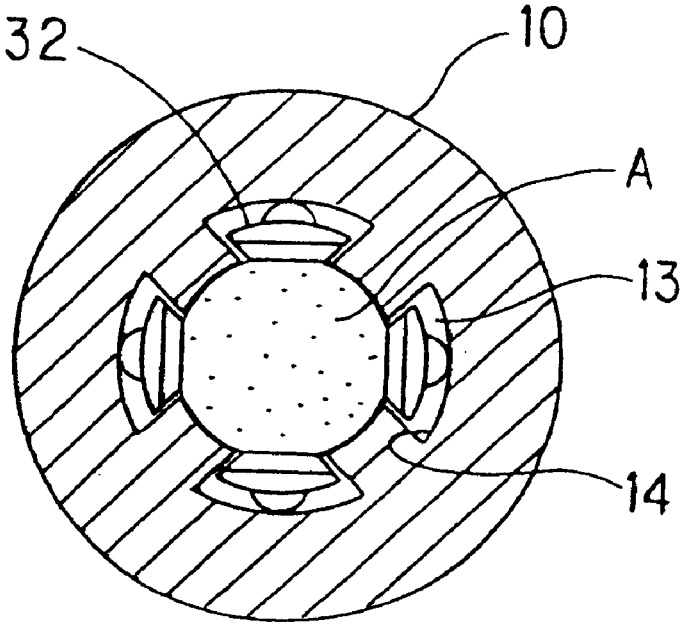
FIG. 16 is a sectional view taken along line G—G of FIG. 15.
Figure 17:
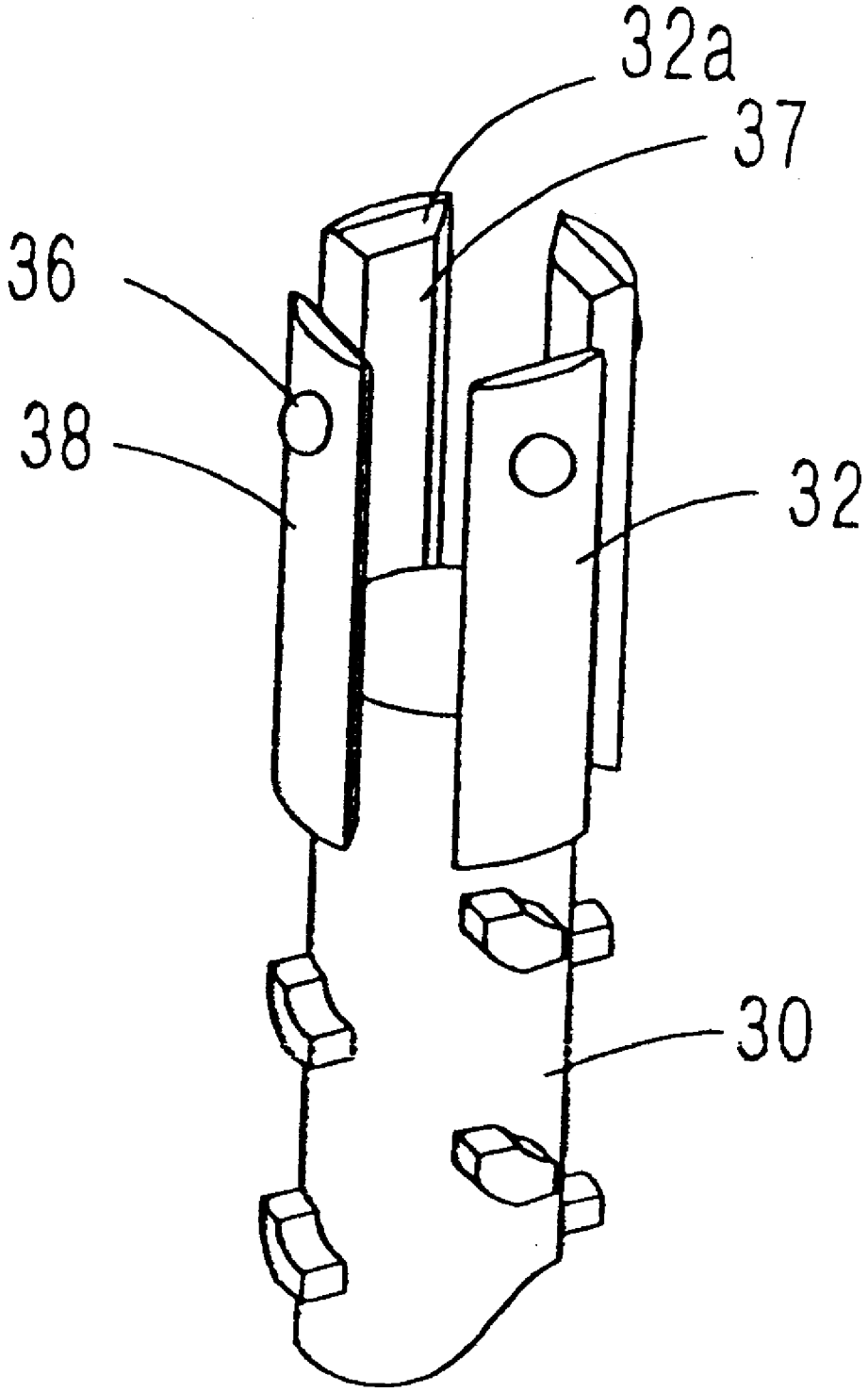
FIG. 17 is a perspective view showing a push rod according to the sixth embodiment of the present invention.

In FIGS. 15 through 17, a sixth embodiment according to the present invention will be shown.

In this embodiment, the claws 32 and the sliding grooves 13 are engaged in such a manner that the claws 32 cannot escape to the side of the inside diameter of the front cylinder 10.

To be precise, each of the sliding grooves 13 of the front cylinder 10 has a cross section in the form of a wedge, a short inner circumferential line on the inside diameter side, and a long outer circumferential line on the outside diameter side.

Further, each of the claws 32 has a cross section in the form of a wedge similar to a cross section of the respective sliding grooves 13 so as to be exactly housed in the respective sliding grooves 13. On the outer circumferential surfaces 38 of the claws 32, the sliding projections 36 are arranged as sliding contact sections and come in contact with the sliding contact surfaces 14. Further, at an upper end of the respective claws 32, a tapered surface 32*a* which is tapering in a direction of the inside diameter is provided, and also the inner circumferential surface 37 which retains the stick type cosmetic material A is formed to be flat.

As described above, by engaging the claws 32 with the sliding grooves 13 in such a manner that the claws 32 cannot escape, it is possible to prevent the claws 32 from falling down in a direction of the inside diameter or being bent. Further, in assembling, if the claws 32 are engaged from edges of the sliding grooves 13, the claws 32 are securely installed in the sliding grooves 13.

Further, since the tapered surface 32*a* is installed at an upper end of the respective claws 32, when the stick type cosmetic material A is inserted between the claws 32, the stick type cosmetic material A is smoothly guided to the center of the claws 32. Therefore, the stick type cosmetic material A can be installed easily and securely.

Incidentally, engagement of the sliding grooves 13 and the claws 32 is not restricted to this embodiment in which the cross section in the form of a wedge is applied. It will be sufficient if the sliding grooves 13 and the claws 32 can be engaged in such a manner that the claws 32 do not escape to the side of the inside diameter.

Figure 18:
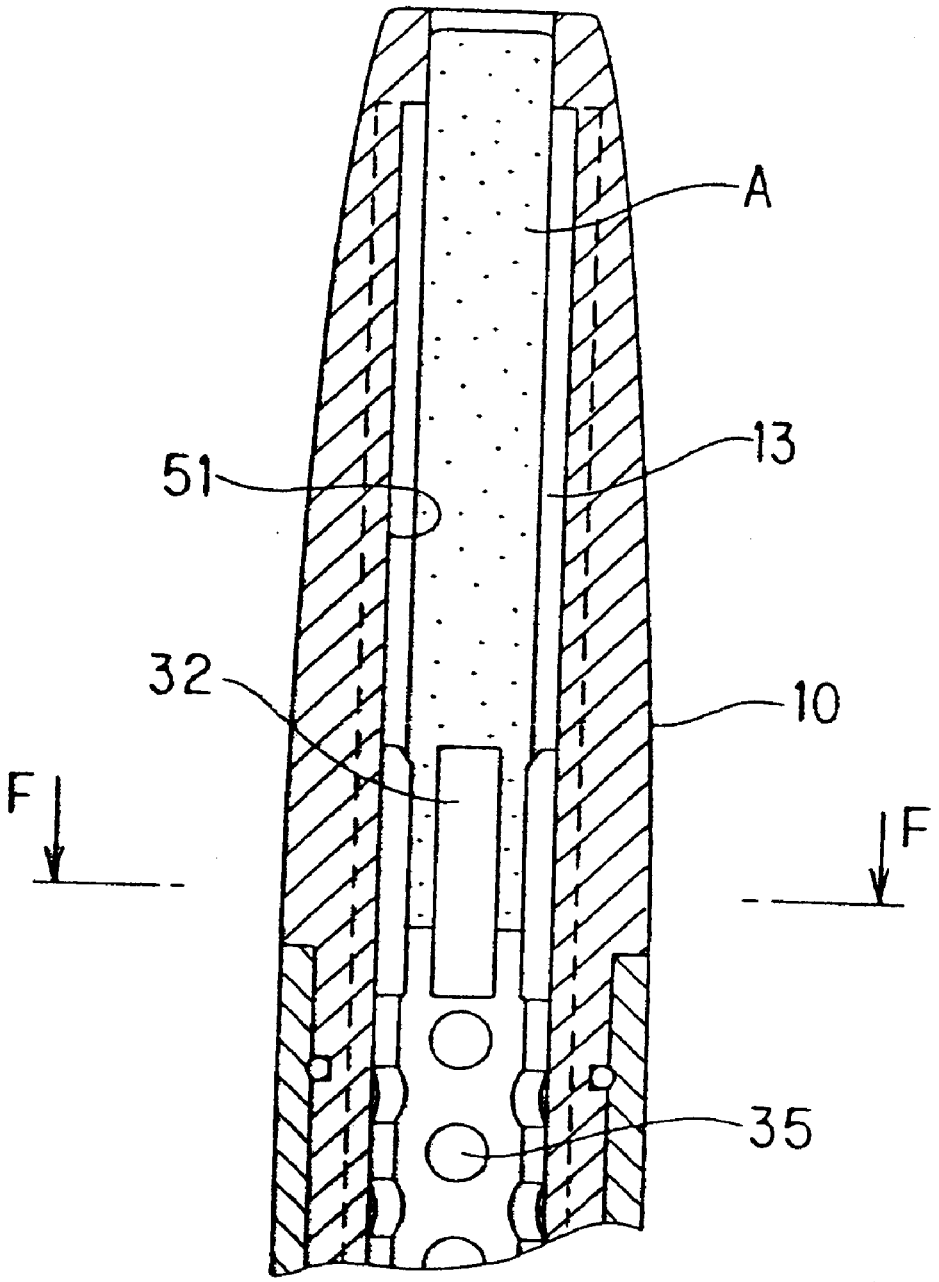
FIG. 18 is a partially sectional view showing a stick type cosmetic material feeding container according to a seventh embodiment of the present invention.
Figure 19:
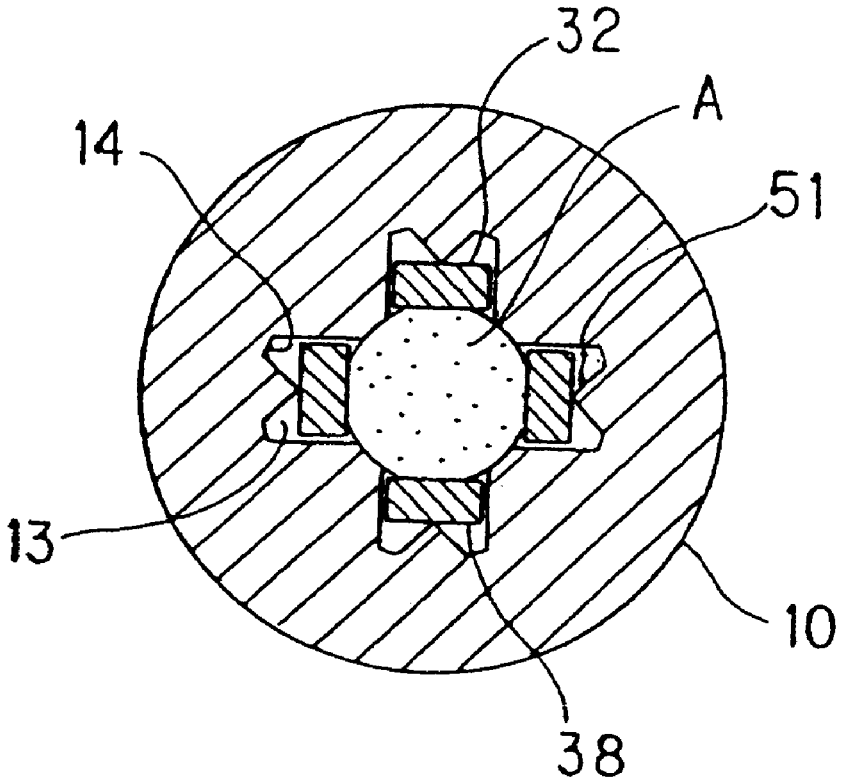
FIG. 19 is a sectional view taken along line F—F of FIG. 18.
Figure 20:
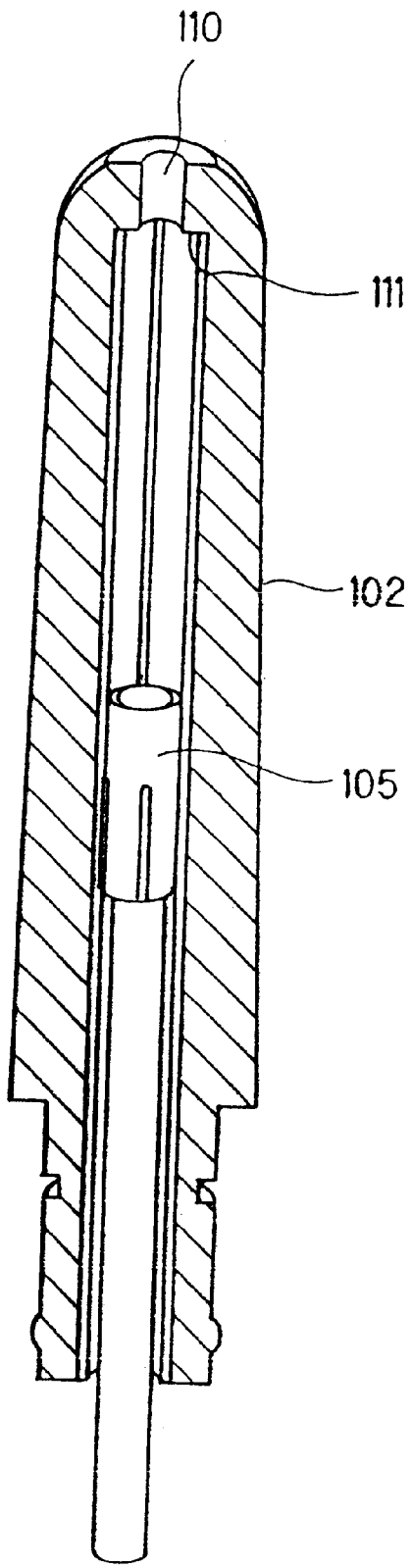
Fig.20 PRIOR ART
FIG. 20 is a partially sectional view showing a conventional stick type cosmetic material feeding container.
Figure 21:
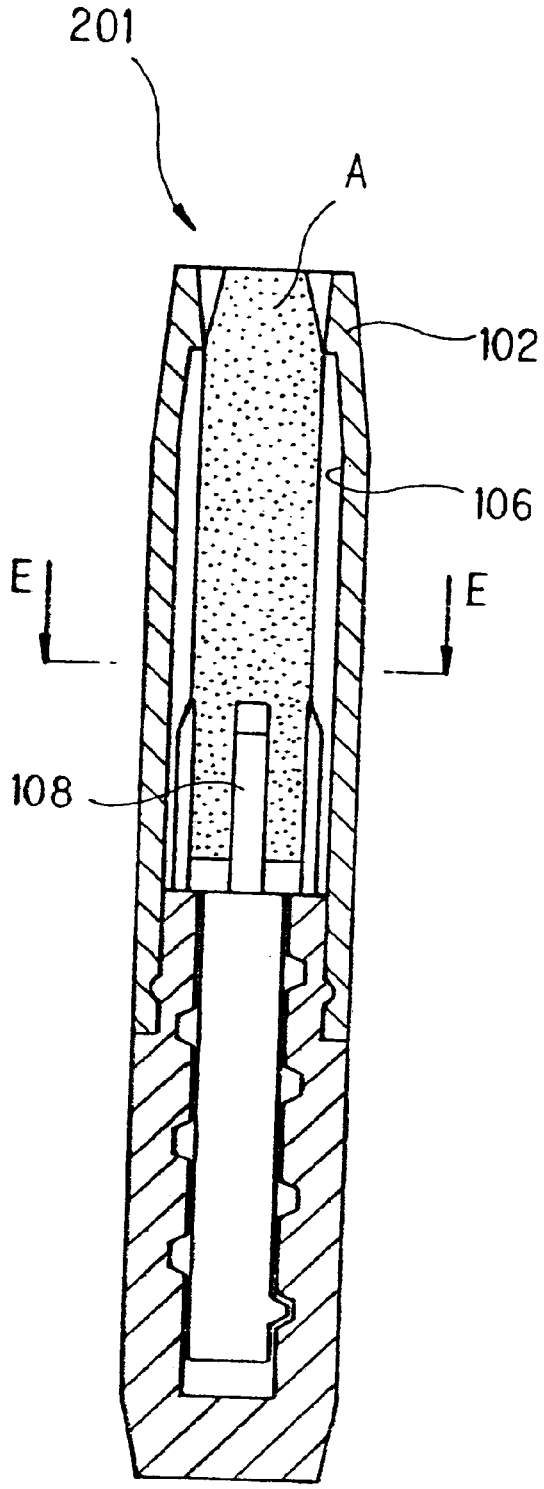
Fig.21 PRIOR ART
FIG. 21 is a sectional view showing a conventional stick type cosmetic material feeding container.
Figure 22:
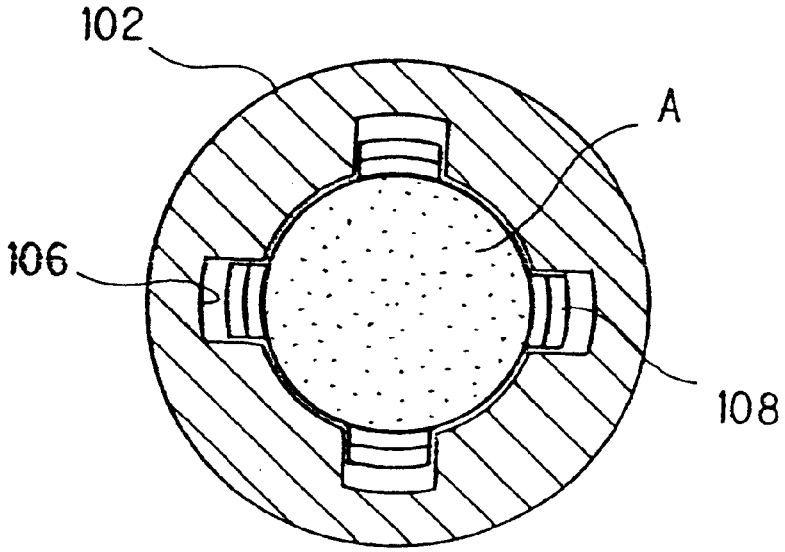
Fig.22 PRIOR ART
FIG. 22 is a sectional view taken along line E—E of FIG. 21.
Figure 23:
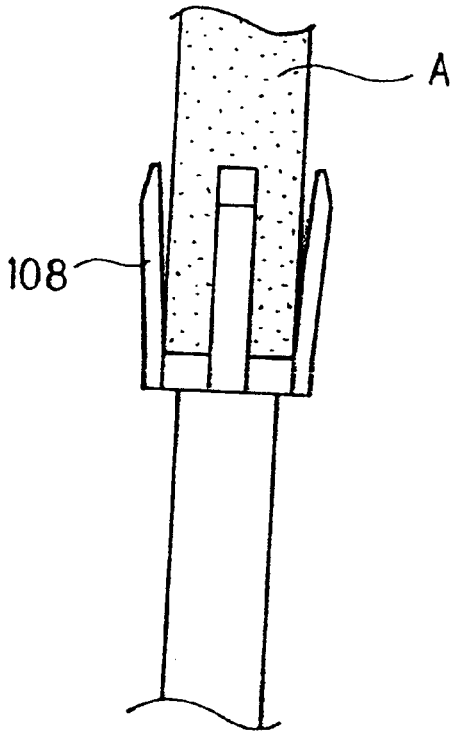
PRIOR ART Fig.23
FIG. 23 is an explanatory drawing showing a state that a stick type cosmetic material is inserted in a conventional core chuck.
Figure 24:
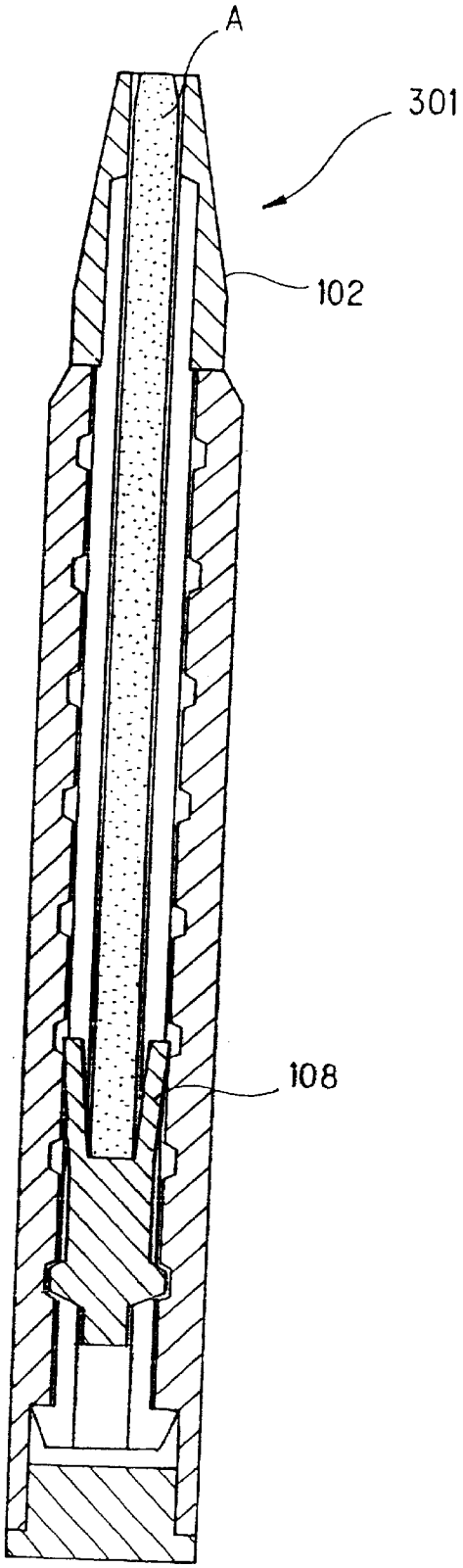
PRIOR ART Fig.24
FIG. 24 is a sectional view showing a conventional stick type cosmetic material feeding container.

In FIGS. 18 and 19, a seventh embodiment according to the present invention will be shown.

In this embodiment, unlike the first through sixth embodiments, the sliding contact section is not installed on the outer circumferential surface 38 of the respective claws 32, but installed on the respective sliding contact surfaces 14. In other words, the sliding convex lines 51 are installed on the sliding contact surfaces 14 as the sliding contact sections. The sliding convex lines 51 extend in an axial direction covering at least range of movement of the claws 32. Further, each of the sliding convex lines 51 has a cross section in the shape of a triangle and comes into contact with the outer circumferential surface 38 of the respective claws 32 at the apex of the triangle.

Thus, by installing each of the sliding contact section on the side of the respective sliding contact surfaces 14, operation and effect same as those of the first through sixth embodiments described above (especially the fourth embodiment) can also be realized. In other words, since each of the claws 32 is supported by the respective sliding convex lines 51, it is possible to prevent any deformation, such as an unnecessary spread of the claws 32. Further, since the sliding convex line 51 and the outer circumferential surface 38 come into contact with each other at the apex of a triangle and a contact area is small, it is possible to minimize a possibility of occurrence of large frictional resistance and the stroke of the push rod 30 (claws 32) is not obstructed.

That concludes the description of the embodiments according to the present invention. Each of the embodiments described above exemplifies the present invention. Of course, the present invention is not restricted to the contents of the embodiments described above.

For example, the shape of the claws 32 is not restricted to those described in the embodiments described above. As long as the claws 32 can retain the stick type cosmetic material A, any optional shape can be adopted.

Further, a stick type cosmetic material feeding container according to the present invention is not restricted to a type of stick type cosmetic material feeding container (a so-called disposable type stick type cosmetic material feeding container) in which the front cylinder is always fitted to the container body. A type of stick type cosmetic material feeding container (a so-called cartridge type stick type cosmetic material feeding container) in which the front cylinder section is an attachable and detachable cartridge is also included.

Further, a shape of the sliding contact section is also not restricted to the shapes of the sliding projections 36, the sliding convex lines 39, and the sliding convex lines 51 according to the embodiments described above.

Further, it is sufficient that as long as the sliding contact sections (the sliding projections 36, sliding convex lines 39, and sliding convex lines 51) come into contact with the sliding contact surfaces 14 or the outer circumferential surfaces 38 of the claws 32 at least when the stick type cosmetic material A is retained by the claws 32. In other words, it does not matter even though there is a space between the respective sliding contact sections and the respective sliding contact surfaces 14 or the outer circumferential surface 38 of the respective claws 32.

What is claimed is:

1. A stick type cosmetic material feeding container comprising:

a front cylinder adapted to house a stick type cosmetic material in such a manner that the stick type cosmetic material can advance and retreat;

a container body which is rotatably connected with the front cylinder; a cosmetic material retaining section composed of a plurality of claws adapted to retain the stick type cosmetic material in such a manner that the stick type cosmetic material is sandwiched between the claws, and which rotates synchronously with the front cylinder;

a plurality of sliding grooves which are formed on an inner circumferential surface of the front cylinder and in which the claws are housed, wherein the stick type cosmetic material is fed up or fed down by advancement or retreat of the cosmetic material retaining section in the front cylinder resulting from rotations of the front cylinder relative to the container body; and a sliding contact section provided on at least one of an outer circumferential surface of the respective claws and a sliding contact surface of the respective sliding grooves, wherein each of the claws is always in contact with the sliding contact surface via the sliding contact section when the stick type cosmetic material is supported between the claws.

2. A stick type cosmetic material feeding container according to claim 1, wherein the sliding contact section is a projection formed on the outer circumferential surface of the respective claws.

3. A stick type cosmetic material feeding container according to claim 1, wherein the sliding contact section is a convex line which is formed to extend approximately a total length of an outer circumferential surface of the respective claws.

4. A stick type cosmetic material feeding container according to claim 3, wherein the convex line has a cross section in the form of an approximate triangle and comes into contact with the sliding contact surface at an apex of the triangle.

5. A stick type cosmetic material feeding container according to claim 1, wherein the sliding contact section is a convex line which is formed on the sliding contact surface covering at least a stroke range of the respective claws.

6. A stick type cosmetic material feeding container according to claim 5, wherein the convex line has an approximately triangular cross section and comes into contact with the outer circumferential surface of the respective claws at an apex of the triangle.

7. A stick type cosmetic material feeding container according to claim 1, wherein a flat part is formed on an inner circumferential surface of the respective claws.

8. A stick type cosmetic material feeding container according to claim 1, wherein an inner circumferential surface of the respective claws is provided with a difference in level, a cross sectional area surrounded by the inner circumferential surface of the respective claws is narrower at a section under the difference in level than at a section above the difference in level, and the stick type cosmetic material is installable from a side above the difference in level.

9. A stick type cosmetic material feeding container according to claim 1, wherein said claws and said sliding grooves have wedge-shaped cross-sections, and wherein by engaging the claws with the sliding grooves using the wedge-shaped cross-sections, the claws are prevented from escaping in a direction of an inside of the front cylinder.

10. A stick type cosmetic material feeding container according to claim 1, wherein the sliding contact section is an outer circumferential surface of the respective claws which is formed by a cylindrical member.

11. A stick type cosmetic material feeding container according to claim 1, wherein an unevenness is formed in a region between the sliding grooves on the inner circumferential surface of the front cylinder.

* * * * *